US006590571B2

(12) United States Patent
Laffargue et al.

(10) Patent No.: US 6,590,571 B2
(45) Date of Patent: Jul. 8, 2003

(54) METHOD OF REDUCING ERRORS IN DISPLAYS USING DOUBLE-LINE SUB-FIELD ADDRESSING

(75) Inventors: Franck Laffargue, Poissy (FR); Roy Van Dijk, Eindhoven (NL); Jurgen Jean Louis Hoppenbrouwers, Eindhoven (NL)

(73) Assignee: Koninklijke Philips Electric N.V., Eindhover (NL)

( * ) Notice: Subject to any disclaimer, the term of this patent is extended or adjusted under 35 U.S.C. 154(b) by 188 days.

(21) Appl. No.: 09/832,721

(22) Filed: Apr. 11, 2001

(65) Prior Publication Data

US 2001/0048431 A1 Dec. 6, 2001

(30) Foreign Application Priority Data

Apr. 25, 2000 (EP) ..... 00201481

(51) Int. Cl.[7] ..... G09G 5/00

(52) U.S. Cl. ..... 345/204; 345/63; 345/89; 345/690; 345/691

(58) Field of Search ..... 345/204, 87–89, 345/690–691, 60, 63, 67–68, 103, 98–100, 694

(56) References Cited

U.S. PATENT DOCUMENTS 5,726,718 A * 3/1998 Doherty et al. ..... 348/771
5,953,002 A * 9/1999 Hirai et al. ..... 345/204
6,476,824 B1 * 11/2002 Suzuki et al. ..... 345/690

* cited by examiner

*Primary Examiner*—Richard Hjerpe
*Assistant Examiner*—Francis Nguyen
(74) *Attorney, Agent, or Firm*—Daniel J. Piotrowski

(57) ABSTRACT

Method of calculating new luminance value data based on original luminance value data to be displayed on a matrix display device, where luminance value data are coded in sub-fields, and double-line addressing for the least significant sub-fields is used for reducing the addressing time. A reduction of the difference between the new data and the original data is obtained by computing a new common value for the least significant sub-fields of a set of neighboring or adjacent lines, and new values for the most significant sub-fields of each line of said set of adjacent lines. The method comprises embodiments which are applicable to both binary and non-binary sub-fields.

15 Claims, 4 Drawing Sheets

METHOD OF REDUCING ERRORS IN DISPLAYS USING DOUBLE-LINE SUB-FIELD ADDRESSING

FIELD OF THE INVENTION

The invention relates to a method of determining new luminance value data based on original luminance value data to be displayed on a matrix display device, where said luminance value data are coded in sub-fields, said sub-fields comprising a group of most significant sub-fields, and a group of least significant sub-fields, wherein a common value for the least significant sub-fields is determined for a set of lines.

The invention also relates to a matrix display device comprising means for determining new luminance value data based on original luminance value data to be displayed on a matrix display device in accordance with said method.

The invention may be used e.g. in plasma display panels (PDPs), plasma-addressed liquid crystal panels (PALCs), liquid crystal displays (LCDs), Polymer LED (PLEDs), Electroluminescent (EL), television sets used for personal computers, and so forth.

BACKGROUND OF THE INVENTION

A matrix display device comprises a first set of data lines (rows) $r_1 \ldots r_N$ extending in a first direction, usually called the row direction, and a second set of data lines (columns) $c_1 \ldots c_M$ extending in a second direction, usually called the column direction, intersecting the first set of data lines, each intersection defining a pixel (dot).

A matrix display device further comprises means for receiving an information signal comprising information on the luminance value data of lines to be displayed and means for addressing the first set of data lines (rows $r_1, \ldots r_N$) in dependence on the information signal. Luminance value data are hereinafter understood to be the grey level in the case of monochrome displays, and each of the individual levels in color (e.g. RGB) displays.

Such a display device may display a frame by addressing the first set of data lines (rows) line by line, each line (row) successively receiving the appropriate data to be displayed.

In order to reduce the time necessary for displaying a frame, a multiple line addressing method may be applied. In this method, more than one, usually two, neighboring, and preferably adjacent lines of the first set of data lines (rows) are simultaneously addressed, receiving the same data.

This so-called double-line addressing method (when two lines are simultaneously addressed) effectively allows speed-up of the display of a frame, because each frame requires less data, but at the expense of a loss of the quality with respect to the original signal, because each pair of lines receives the same data, which induces a loss of resolution and/or sharpness due to the duplication of the lines.

For the above-mentioned matrix display panel types, the generation of light cannot be modulated in intensity to create different levels of grey scale, as is the case for CRT displays. On said matrix display panel types, grey levels are created by modulating in time: for higher intensities, the duration of the light emission period is increased. The luminance data are coded in a set of sub-fields, each having an appropriate duration or weight for displaying a range of light intensities between a zero and a maximum level. The relative weight of the sub-fields may be binary (i.e. 1, 2, 4, 8, . . . ) or not. This sub-field decomposition, described here for grey scales, will also apply hereinafter to the individual colors of a color display.

In order to reduce loss of resolution, line doubling can be done for only some less significant sub-fields (LSB sub-fields). Indeed, the LSB sub-fields correspond to a less important amount of light, and partial line doubling will give less loss in resolution.

The use of partial line doubling should be effective. Only a few LSB sub-fields doubled would yield a little gain of time. Too many sub-fields doubled would yield an unacceptable loss of picture quality.

Another aspect that influences the quality is the calculation method of the new data of doubled sub-fields. Different calculation methods giving different results can be used. The method used should give the best picture quality, as seen by the observer's eyes.

As the LSBs are doubled in partial line doubling, the value of the LSB data for two neighbouring or adjacent lines must be the same. The following methods are used for the calculation of these data:

The LSB data of odd lines is used on the adjacent even lines (simple copy of bits).

The LSB data of even lines is used on the neighbouring or adjacent odd lines (simple copy of bits).

The average LSB data of each pair of pixels is used for both new LSB values.

These methods allow a reduction of the addressing time, at the expense of a loss of resolution. However, a difference, and in some instances a large difference, may exist between the original luminance values to be displayed and the new luminance values actually displayed.

SUMMARY OF THE INVENTION

It is an object of the invention to provide a method of calculating new data to be displayed on a matrix display device, using multiple line addressing of least significant weight sub-fields, where a loss of resolution and/or sharpness with respect to the image obtained by single line addressing of all sub-fields is reduced, and preferably minimized.

To this end, a first aspect of the invention provides a method as defined in claim 1 of determining new luminance value data based on original luminance value data. In the traditional methods, the most significant sub-fields (MSB) of each line are kept as in the original data. By including the most significant sub-fields as well as the least significant sub-fields in the calculation, one broadens the set of possible solutions. This invention thereby allows better results.

The invention provides a method which is applicable to both binary and non-binary sub-fields.

Specific embodiments of this method are defined in the dependent claims 2 to 11.

Claims 3, 4 and 5 disclose embodiments which are applicable to both binary sub-fields. These methods are easy to program.

Claims 6 to 9 disclose embodiments which are applicable to both binary and non-binary sub-fields.

Claims 10 to 14 disclose simplified versions which are applicable to both binary and non-binary sub-fields, and, although simplified and easy to implement, having good practical results.

A matrix display device is defined in claim 15.

These and other aspects of the invention are apparent from and will be elucidated with reference to the embodiment(s) described hereinafter with reference to the accompanying drawings.

DETAILED DESCRIPTION OF PREFERRED EMBODIMENTS

Figure 1:
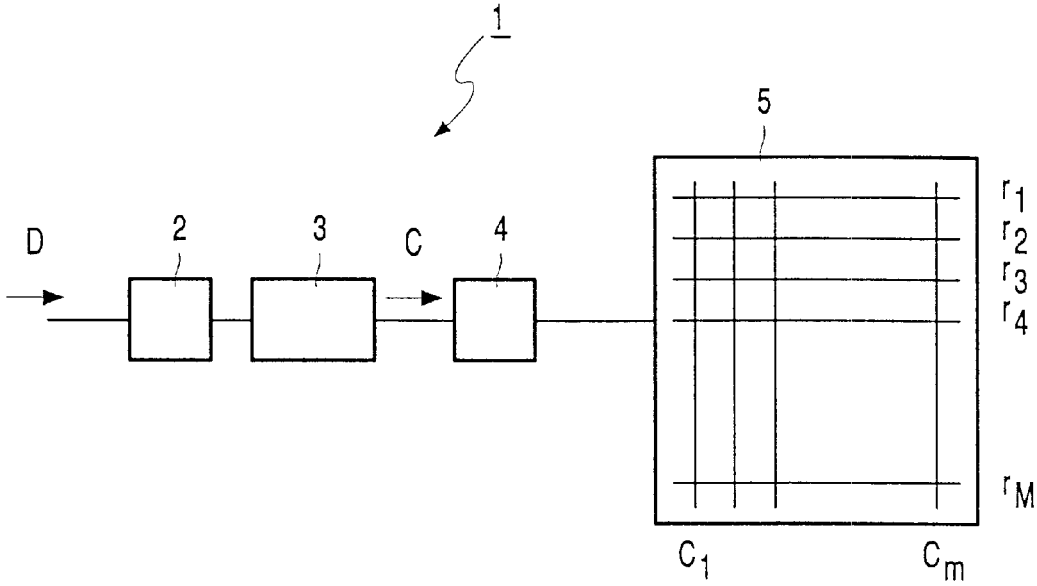
FIG. 1 schematically shows a matrix display device.

FIG. 1 is a schematic diagram of a device comprising a matrix display panel 5, showing a set of display lines (rows) $r_1, r_2 \ldots r_m$. The matrix display panel 5 comprises a set of data lines (columns) $c_1 \ldots c_N$ extending in a second direction, usually called the column direction, intersecting the first set of data lines, each intersection defining a pixel (dot) $d_{11} \ldots d_{NM}$. The number of rows and columns need not be the same.

The matrix display furthermore comprises a circuit 2 for receiving an information signal D comprising information on the luminance of lines to be displayed and a driver circuit 4 for addressing the set of data lines (rows $r_1, \ldots r_M$) in dependence on the information signal D, which signal comprises original line luminance values $D_1, \ldots D_M$.

The display device in accordance with the invention comprises a computing unit (3) for computing new line luminance values C of pixels $d_{11}, \ldots d_{NM}$ on the basis of original line luminance values $D_1, D_2, \ldots D_m$.

An example of how the prior-art methods (i.e. simple copy of bits, or averaging) are improved is given below, in a case where eight sub-fields are used, grouped in 4 most significant sub-fields, and 4 least significant sub-fields.

Even though the average value for applying partial line doubling yields reasonable results if the most significant sub-fields are left unchanged, better results can be obtained in some cases. The invention is based on the recognition that, in addition to changing the least significant sub-fields, changing also the most significant sub-fields when line doubling is applied reduces the error.

For instance, if we have the two following original luminance values A and B of pixels in the 8 bit grey scale levels:

A=31=0001 1111

B=32=0010 0000

For 4 less significant bits addressed at the same time (doubled), while taking the average value (rounded at the closer lower integer) on 4 LSBs yields (the average LSB is (1111+0000)/2, the integer part of which is 0111):

A'=23=%0001 0111 MSE=56.5

B'=39=%0010 0111 where MSE is the mean square error:

$$MSE = \frac{(A - A')^2 + (B - B')^2}{2}$$

Taking the average value of the 4 LSB therefore leads to a considerable MSE in this example.

However, instead of taking the average value, if we add only 1 to A, the new 4 LSB values of A and B are now the same:

A'=32=%0010 0000 MSE=0.5

B'=32=%0010 0000

A line doubling on the 4 least significant sub-fields can now be applied and the difference between old and new values is only 1, so the error is 1 for the first line, and zero for the second line. Then the MSE is minimized. To achieve this result, one can see that not only the least significant sub-fields, but also the most significant sub-fields are changed between A and A'.

In the case of 4 least significant binary sub-fields addressed with line doubling and when the error is higher than 8, the error can be reduced to a value lower than 8 by changing the values of the most significant sub-fields.

In the following method, the value of the most significant sub-fields can be changed. Here, "A" is the original data of a first line of a pair of lines to be displayed, "a" is the weight of the least significant sub-fields of said first line, "B" is the original data of the other line of said pair of lines, "b" is the weight of the least significant sub-fields of said line, A' is the new data for said first line, B' is the new data for said other line, r is a real number, and n is the number of doubled least significant sub-fields.

```
Δ= a − b
if(Δ>0)                 Δ' = 2^n−Δ
else                    Δ' = −2^n−Δ
if(abs(Δ) > 2^(n−1))
{                   A ' = A + int(Δ'*r)
                      B' = B −Δ'+int(Δ'*r)}
else
{                   A ' = A − (Δ*r)
                      B' = B + Δ − int(Δ*r) }
```

In the above expressions, "int( )" means taking the integral part of the expression between brackets. "abs ( )" means that the absolute value of the expression between brackets has to be determined. The parameter r may be given a value of ½. In that case, the mean square error is minimized. Other values may be given, e.g. A/(A+B), thereby spreading the largest part of the error to the largest of A and B, and spreading the relative error evenly.

The new values A' and B' obtained in accordance with this method have the same least significant sub-fields.

This calculation method will provide good results. However, when the original values of A and B are almost equal to 0 or 255 (minimum and maximum values, when using 8 binary sub-fields), problems of over-ranging can appear.

For instance, if

A=254=1111 1110

B=66=0100 0010 the above minimization method will give

A'=256=1 0000 0000

B'=64=0100 0000 however, in an eight sub-field system, A' will overflow to zero.

The new values are completely wrong (over-ranging). Better values may be obtained, by taking, in this case, the average value of the least significant sub-fields.

A'=248=1111 1000

B'=72=0100 1000

Therefore, if the new values A' or B' obtained are outside the limits of acceptable values, i.e. 0, . . . 255 for eight sub-fields, the following step is added to the method, taking the average instead of the obtained values.

```
if ( A'<0 or
     B'<0 or
     A'>255 or
     B'>255 )
{    A' = A − int(Δ*r)
       B' = B + Δ − int(Δ*r)
```

Figure 2:
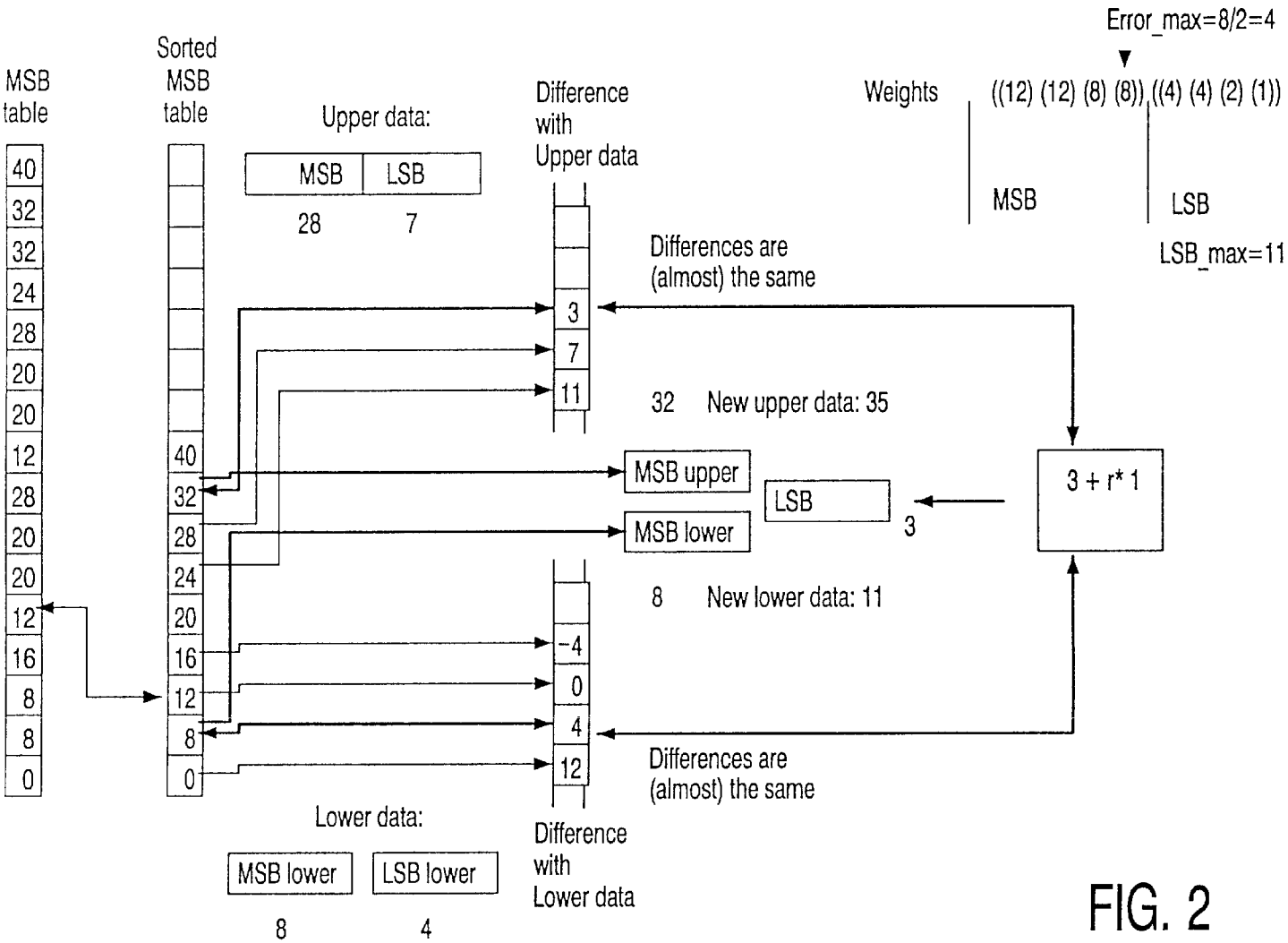
FIG. 2 schematically shows an embodiment of the invention, with a numerical example.

FIG. 2 schematically shows the method as defined in claim 6, with a numerical example of non-binary sub-fields. Eight sub-fields, having weights 12, 12, 8, 8 (most significant sub-fields) and 4, 4, 2, 1 (least significant sub-fields) are used. In the following, "A" is the weight of the most significant sub-fields of the original data of a first line of a pair of lines to be displayed, "a" is the weight of the least significant sub-fields of said first line, "B" is the weight of the most significant sub-fields of the original data of the other line of said pair of lines to be displayed, "b" is the weight of the least significant sub-fields of said line.

The method comprises the steps of:

(a) computing lsb_max as the addition of the weights of all least significant sub-fields (in this case 4+4+2+1, being 11);

(b) building a table ('MSB table') of the weight of all possible combinations of the most significant sub-fields;

These steps are executed once;

The following steps are executed for each dot of each pair of lines:

(c) building a first corresponding table of the differences between the data A+a of the first line of a pair of lines to be displayed, and each element of the MSB table ('first differences set')

(d) building a second corresponding table of the differences between the data B+b of the other line of said pair of lines, and each element of the MSB table ('subsequent differences set')

(e) determining, among all pairs of values, the first one taken from the first differences set and the second one taken from the second differences set, the pairs of values, so that the absolute value of their difference is minimum among all said pairs ('minimal pairs') (in this case, the smallest difference is 1 and may be obtained by taking the values 3 and 4 (first minimal pair) or the values 11 and 12 (second minimal pair));

(f) determining, for all said minimal pairs, c as being the integral part of the sum of the lowest of the pair of determined difference values (MIN(A+a−A'),(B+b−B'))) plus the absolute value of their difference multiplied by r,(r*ABS((A+a−A')−(B+b−B'))) r being a real number, if said integral part is positive and smaller than twice lsb_max;

zero if said integral part is negative;

lsb_max if said integral part is larger than twice lsb_max.

(g) determining, for all said minimal pairs, the error as being the absolute value of A+a−A'−c+B+b−B'−c;

(h) selecting, among all minimal pairs, a pair having the smallest error('selected minimal pair') (here both minimal pairs give the same result and any of them may be chosen);

(i) determining the weight of the most significant sub-fields of the new data of said first line to be displayed as being the element of the MSB table corresponding to the first element of the selected minimal pair(here 32 for the first minimal pair, and 24 for the second minimal pair);

(j) determining the weight of the most significant sub-fields of the new data of said other line to be displayed as being the element of the MSB table corresponding to the second element of the selected minimal pair (here 8 for the first minimal pair, and 0 for the second minimal pair);

(k) determining the weight of the least significant sub-fields of the new data for both said first and said other line to be displayed as being the value of c for the selected minimal pair(here taking r as ½, c is 3 for the first minimal pair, and 11 for the second minimal pair).

Preferably prior to step c, a value error_max is computed, determined or set, error_max being half the weight of the lowest most significant sub-field (in this case error_max is equal to 4). In the first corresponding table, the values comprised between minus error_max and lsb_max+error_max (in this case between −4 and 15) are selected as a reduced first difference set (only these values are shown in the diagram, here 3, 7 and 11), and in the second corresponding table, the values between minus error_max and lsb_max+error_max are selected as a reduced second difference set (again only these values are shown in the diagram, here −4, 0, 4, 12), and in step e determining, among all pairs of values, the first one being taken from the reduced first differences set and the second one being taken from the reduced second differences set, the pairs of values, so that the absolute value of their difference is minimum among all said pairs ('minimal pairs') (in this case the minimum is 1 and may be obtained by taking the values 3 and 4 (first solution) or 11 and 12 (second solution). In this preferred embodiment, the number of pairs to be considered is strongly reduced, thus increasing the speed of the method.

Steps (d) and (e) may be performed more easily if the MSB table is first sorted, and duplicate values are eliminated, as shown in FIG. 2.

The first solution gives 32+3=35 for the upper line and 8+3=11 for the lower line. The second solution gives 24+11=35 for the upper line and 0+11=11 for the lower line. The error is equal for both solutions. The first solution is displayed in bold on FIG. 2. As above, parameter r may be chosen for spreading the error differently between the two lines.

Using non-binary sub-fields, the relationship between luminance values, and sub-field combination is not one-to-one, as with binary sub-fields. In the above scheme, the value 20, may be obtained by e.g. 12+8 or by 8+8+4, which are different combinations among most and least significant fields. The method provides values for the most significant fields which are obtainable by a combination of most significant fields. This method provides new values to be displayed, reducing the error and spreading the error evenly among the first and the subsequent line.

The above method applies to two lines. It may be generalized to sets of three or more lines, as follows. Steps (d) and (e) are performed for each line of the set of lines. In step (h), a set of values is searched among all combinations of differences sets, which gives the smallest differences. Step (i) is also performed for each line of the set of lines.

Figure 3:
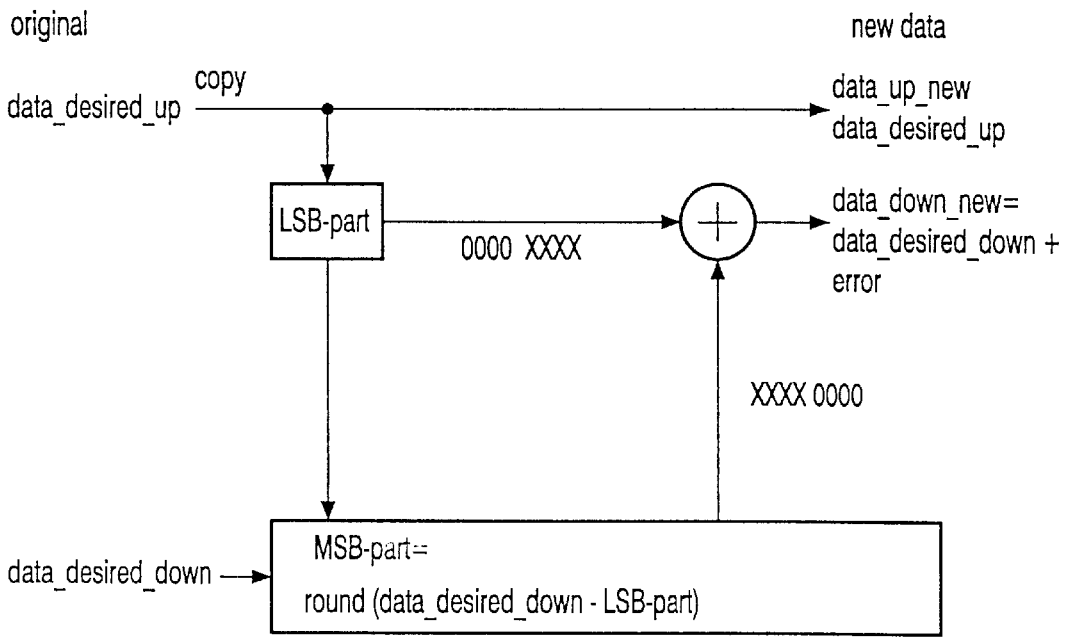
FIG. 3 schematically shows a simplified embodiment of the invention, applicable to binary sub-fields, a numerical example being shown in FIG. 4.

FIG. 3 schematically shows the method defined in claim 10.

In this method, the luminance data for one of the pairs of lines is simply used as data to be displayed. (dataup_new =data_desired_up).

The weight of the least significant sub-fields is extracted (LSB-part).

One computes the weight of the most significant sub-fields of the new luminance value data of a second line of a pair of lines by subtracting LSB from the original data for said line, and by rounding obtained value to the nearest combination of most significant sub-fields value.

For the new luminance value data of a second line of a pair of lines, one takes the computed weight for the most significant sub-fields, and LSB for the least significant sub-fields. In the numerical example of this method, shown in FIG. 4, the original value of a first line is 3 (0000 0011 in binary), and the original value of a second line is 141 (1000 1101 in binary). The first value is simply copied. The least significant sub-fields (0011 in binary) are extracted. A new value for the most significant sub-fields of the second line is obtained by subtracting the LSB from the original value for the second line. The rounding may be performed by adding half the value of the lower most significant field, in this case 8, and taking the most significant sub-fields thereof.

Figure 4:
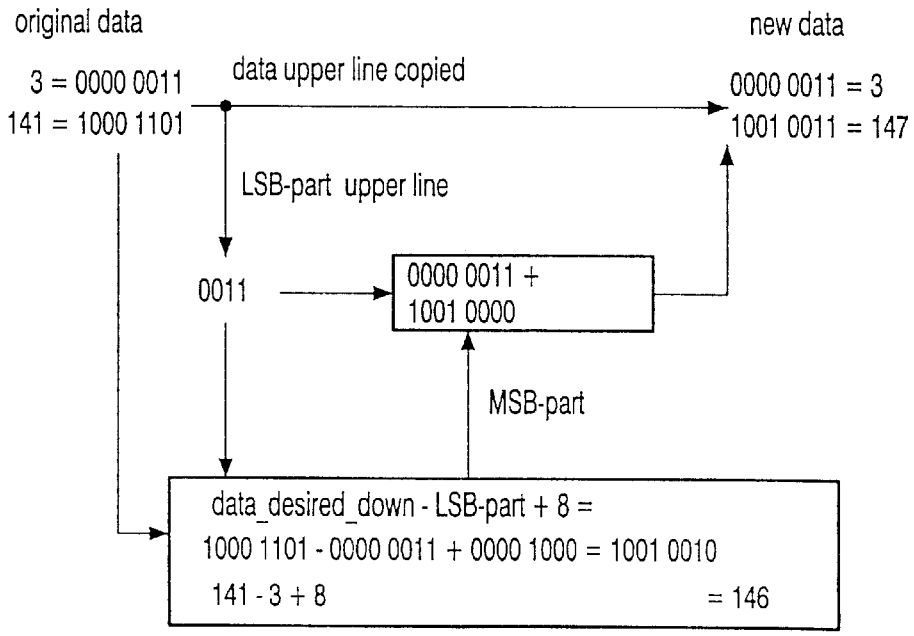

Although the numerical example shown in FIG. 4 relates to binary sub-fields, this method also applies to non-binary sub-fields.

This method may be improved by taking, as the first line, the line with the smallest LSB sub-fields.

Figure 5:
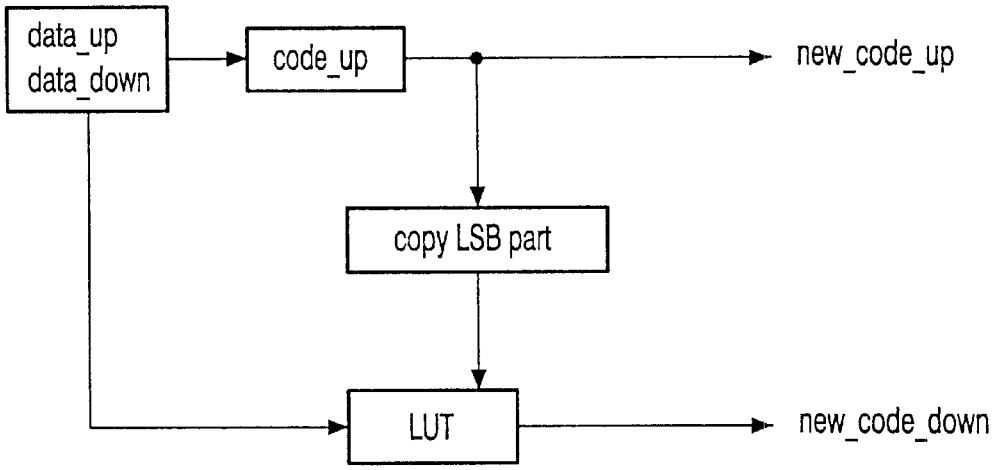
FIGS. 5 and 6 schematically show simplified embodiments of the invention, applied to non-binary sub-fields.

All of these methods may easily be implemented in a programming language, the program having, as input, the original luminance values to be displayed, and, as output, the new luminance values. Alternatively, a look-up table mechanism may be used. A table ('look-up table') has an entry for each pair of values of the original luminance values, and contains the corresponding precalculated pair of new values. A drawback of this is that the look-up table may be very large, i.e. 256×256 elements for 8 bits binary sub-fields. For the method as defined in claim 3, smaller look-up table may be used, having, as shown in FIG. 5, an entry for each combination of values of the second line and of values of the LSB-part, i.e. 256×16 elements for 8 bits binary sub-fields. A substantial reduction of the look-up table size is thereby obtained. This method is applicable to non-binary sub-fields.

Figure 6:
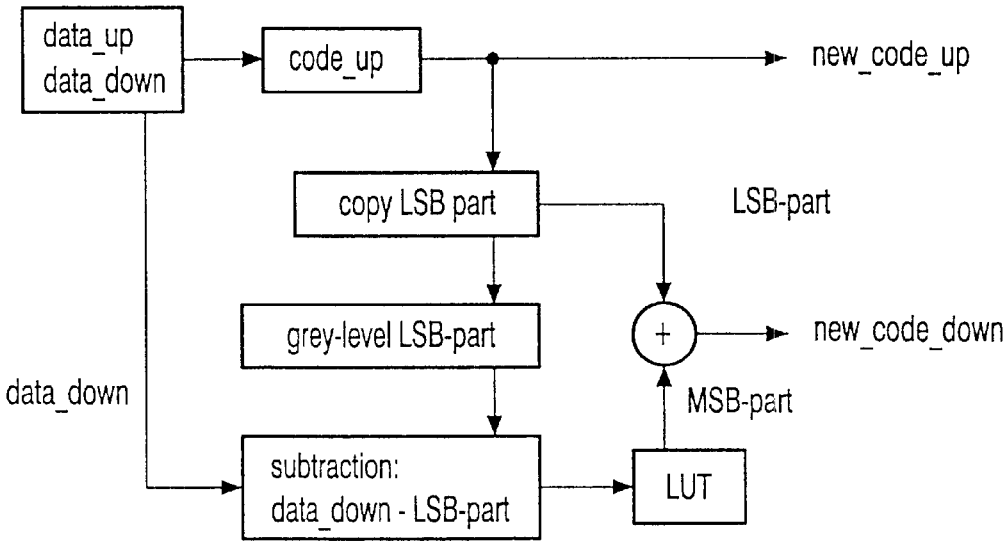

In FIG. 6, the size of the look-up table is further reduced: one computes the difference between the luminance value for the second line, and the luminance value corresponding to the LSB part. This difference is used as input in a look-up table for giving the new most significant fields.

While the invention has been described in connection with preferred embodiments, it will be understood that modifications thereof within the principles outlined above will be evident to those skilled in the art, and thus the invention is not limited to the preferred embodiments but is intended to encompass such modifications. It is possible to interchange lines and columns. The invention is applicable to display devices in which the sub-field mode is applied. The invention can be implemented by means of hardware comprising several distinct elements, and by means of a suitably programmed computer.

What is claimed is:

1. A method of determining new luminance value data based on original luminance value data to be displayed on a matrix display device, said new luminance value data being coded in sub-fields, said sub-fields consisting of a group of most significant sub-fields, and a group of least significant sub-fields, said device comprising a set of lines, said lines being grouped in sets of neighbouring or adjacent lines, wherein a common value for the least significant sub-fields is addressed simultaneously to the set of lines, characterized in that a new common value for the least significant sub-fields of said set of neighbouring or adjacent lines is computed and addressed simultaneously to said set of lines, and new values for the most significant sub-fields of each line of said set of neighbouring or adjacent lines are computed and addressed to each line of said set.

2. A method as claimed in claim 1, wherein said sets of neighbouring or adjacent lines comprise pairs of lines.

3. A method as claimed in to claim 2, wherein the sub-fields have weights proportional to successive powers of two, the luminance value data being larger than or equal to zero, and smaller than two to the Nth power ($2^N$), N being the number of sub-fields, "A" being the original data of a first line of a pair of lines to be displayed, "a" being the weight of the least significant sub-fields of said first line, "B" being the original data of the other line of said pair of lines, "b" being the weight of the least significant sub-fields of said line, n being the number of doubled least significant sub-fields, r being a real number, the method comprising the steps of computing a difference Δ of a minus b (Δ=a−b);

computing Δ' as being 2 to the nth power minus Δ ($\Delta'=2^n-\Delta$) if Δ is positive, and else being minus 2 to the nth power minus Δ ($\Delta'=-2^n-\Delta$);

computing a new value for A (A') as being equal to the original value of A plus the integral part of the value of Δ' multiplied by r (A'=A+int(Δ'*r)), and a new value for B (B') as being equal to the original value of B minus Δ' plus the integral part of the value of Δ' multiplied by r (B'=B−Δ'+int(A'*r)), if the absolute value of Δ is larger than 2 to the (n−1)th power, and else a new value for A (A') as being equal to the original value of A minus the integral part of the value of Δ multiplied by r (A'=A−int(Δ*r), and a new value for B (B') as being equal to the original value of B plus Δ minus the integral part of the value of Δ multiplied by r (B'=B+Δ−int(Δ*r));

if said new value of A or said new value of B is smaller than zero, or equal to or larger than 2 to the Nth power, replacing said new values of A and B, respectively, by the original value of A minus the integral part of the value of Δ multiplied by r (A−int(Δ*r), and by the original value of B plus Δ minus the integral part of the value of Δ multiplied by r (B+Δ−int(Δ*r)).

4. A method as claimed in claim 3, characterized in that r is given the value one half (r=½).

5. A method as claimed in claim 3, characterized in that r is given the value A divided by the sum of A and B (r=A/(A+B)).

6. A method as claimed in claim 2, "A" being the weight of the most significant sub-fields of the original data of a first line of a pair of lines to be displayed, "a" being the weight of the least significant sub-fields of said first line, "B" being the weight of the most significant sub-fields of the original data of the other line of said pair of lines to be displayed, "b" being the weight of the least significant sub-fields of said line, n being the number of least significant sub-fields, comprising the steps of (a) computing lsb_max as being the sum of the weights of all least significant sub-fields;

(b) building a table ('MSB table') of the weight of all possible combinations of the most significant sub-fields;

(c) building a first corresponding table of the differences between the data A+a of the first line, and each element of the MSB table('first differences set', A+a−A');

(d) building a second corresponding table of the differences between the data B+b of the other line of said pair of lines, and each element of the MSB table ('subsequent differences set', B+b−B');

(e) determining, among all pairs of values, the first one taken from the first differences set and the second one taken from the subsequent differences set, the pairs of values, so that the absolute value of their difference is minimum among all said pairs('minimal pairs');

(f) determining, for all said minimal pairs, c as being the integral part of the sum of the lowest one of the pair of determined difference values (MIN(A+a−A'),(B+b−B'))) plus the absolute value of their difference multiplied by r,(r*ABS((A+a−A')−(B+b−B'))) r being a real number, if said integral part is positive and smaller than twice lsb_max;

zero if said integral part is negative;

lsb_max if said integral part is larger than twice lsb_max.

(g) determining, for all said minimal pairs, the error as being the absolute value of A+a−A'−c+B+b−B'−c;

(h) selecting, among all minimal pairs, a pair having the smallest error('selected minimal pair');

(i) determining the weight of the most significant sub-fields of the new data of said first line to be displayed as being the element of the MSB table corresponding to the first element of the selected minimal pair;

(j) determining the weight of the most significant sub-fields of the new data of said other line to be displayed as being the element of the MSB table corresponding to the second element of the selected minimal pair;

(k) determining the weight of the least significant sub-fields of the new data for both said first and said other line to be displayed as being the value of c for the selected minimal pair.

7. A method as claimed in claim 6, characterized in that, prior to step c, a value error_max is computed, determined or set, error_max being half the weight of the lowest most significant sub-field, the values comprised between minus error_max and lsb_max+error_max being selected in the first corresponding table as a reduced first difference set, and the values between minus error_max and lsb_max+error_max being selected in the second corresponding table as a reduced second difference set, and in step e, among all pairs of values, the first one being taken from the reduced first differences set and the second one being taken from the reduced second differences set, the pairs of values, so that the absolute value of their difference is minimum among all said pairs ('minimal pairs').

8. A method as claimed in to claim 6, characterized in that r is given the value one half (r=½).

9. A method as claimed in to claim 6, characterized in that r is given the value of the sum of A plus a divided by the sum of A, a, B and b (r=(A+a)/(A+a+B+b)).

10. A method as claimed in to claim 2, comprising the steps of taking the original luminance value data for the new luminance value data of a first line of a pair of lines;

extracting the weight of the least significant sub-fields of said value, said weight being 'LSB';

computing the weight of the most significant sub-fields for the new luminance value data of a second line of a pair of lines by subtracting LSB from the original data for said line, and by rounding obtained value to the nearest combination of most significant sub-fields value taking the computed weight for the most significant sub-fields for the new luminance value data of said other line, and LSB for the least significant sub-fields.

11. A method as claimed in to claim 10, characterized in that said first line of a pair of lines is selected as the line with the smallest least significant sub-fields weight.

12. A method as claimed in to claim 10 or 11, where the sub-fields have weights proportional to successive powers of two, wherein extracting the weight of the least significant sub-fields is performed by masking the most significant bits.

13. A method as claimed in to claim 10 or 11, characterized in that a set of most and least significant sub-fields representing the luminance value of said first line is determined;

said least significant sub-fields is used as entry, with the original luminance value for said second line, in a precalculated look-up table for giving the new luminance value for said second line.

14. A method as claimed in to claim 10 or 11, characterized in that a set of most and least significant sub-fields representing the luminance value of said first line is determined;

the resulting luminance value level corresponding to said least significant sub-fields is computed;

the difference between the original luminance value for said second line and said resulting luminance value is computed;

said difference is used as entry in a precalculated look-up table for giving the new most significant sub-fields for said second line.

15. A matrix display device (1) comprising a receiving circuit (2) for receiving luminance data comprising original luminance value data of pixels, the matrix display device (1) further comprising a display panel (5) comprising a set of lines $r_1 \ldots r_M$, and a driver circuit (4) for supplying line luminance value data to said lines, said lines being grouped in sets of neighbouring or adjacent lines, wherein a common value for the least significant sub-fields is addressed simultaneously to a set of lines characterized in that the matrix display device (1) comprises a computing unit (3) for computing new line luminance values C of pixels on the basis of the original line luminance values, a new common value for the least significant sub-fields of said set of neighbouring or adjacent lines being computed and addressed simultaneously to said set of lines, and new values for the most significant sub-fields of each line of said set of neighbouring or adjacent lines being computed and addressed to each line of said set.

* * * * *